US006138991A

United States Patent [19]

Myers, Jr.

[11] Patent Number: 6,138,991

[45] Date of Patent: Oct. 31, 2000

[54] VEHICLE-MOUNTED HOIST APPARATUS

[76] Inventor: Robert Myers, Jr., 2330 NW. 140 St., Opalocka, Fla. 33054

[21] Appl. No.: 09/272,511

[22] Filed: Mar. 19, 1999

Related U.S. Application Data

[60] Provisional application No. 60/079,065, Mar. 23, 1998.

[51] Int. Cl.[7] ..... B66D 1/00

[52] U.S. Cl. ..... 254/323; 254/329; 254/334; 414/462; 414/543; 212/180; 212/294

[58] Field of Search ..... 242/243, 323, 242/329, 332, 334; 414/540, 543, 592, 460, 461, 462; 212/175, 176, 180, 294

[56] References Cited

U.S. PATENT DOCUMENTS

| | | | |
|---|---|---|---|
| 78,566 | 6/1868 | Barker | 414/540 |
| 2,509,950 | 5/1950 | Zierke | 414/543 |
| 3,804,263 | 4/1974 | Castonguay | 414/462 X |
| 3,854,594 | 12/1974 | Brookes | 414/543 X |
| 4,338,703 | 7/1982 | Tanner . | |
| 4,419,038 | 12/1983 | Pendergraft | 414/543 |
| 4,597,562 | 7/1986 | Joyce | 254/334 |
| 4,706,939 | 11/1987 | Gagne | 254/332 |
| 4,806,063 | 2/1989 | York . | |
| 4,881,864 | 11/1989 | Amato | 254/323 X |
| 5,085,408 | 2/1992 | Norton et al. | 254/334 X |
| 5,205,700 | 4/1993 | Lin et al. | 414/543 |
| 5,393,193 | 2/1995 | Dagg | 414/540 |
| 5,419,672 | 5/1995 | Poe . | |
| 5,445,487 | 8/1995 | Liscinski, Jr. | 414/543 |
| 5,509,639 | 4/1996 | Ellis | 254/323 X |
| 5,520,498 | 5/1996 | DiBartolomeo | 212/180 X |
| 5,540,537 | 7/1996 | Welch | 414/462 |
| 5,562,534 | 10/1996 | McGough . | |
| 5,662,451 | 9/1997 | Muzzi et al. . | |
| 5,752,799 | 5/1998 | Carey et al. | 414/543 |
| 5,791,858 | 8/1998 | Sasser | 414/462 |
| 5,800,117 | 9/1998 | Milton | 414/540 |
| 5,876,019 | 3/1999 | Morrissey, Jr. et al. | 254/323 |
| 5,967,732 | 10/1999 | Floyd | 414/543 X |
| 5,975,499 | 11/1999 | Ostrobod | 254/329 X |
| 5,975,831 | 11/1999 | Martin | 414/543 |

FOREIGN PATENT DOCUMENTS

| | | | |
|---|---|---|---|
| 1932865 | 6/1969 | Germany | 254/334 |

*Primary Examiner*—Christopher P. Ellis
*Assistant Examiner*—Emmanuel M. Marcelo

[57] ABSTRACT

A hoist apparatus is provided for a vehicle, such as an all terrain vehicle (ATV) and includes a support bracket assembly for mounting on the vehicle. The support bracket assembly includes a horizontal support plate and a hoist-axle-reception channel depending downward from the horizontal support plate. A hoist assembly is provided and is supported by the support bracket assembly. The hoist assembly includes a hoist axle received in the hoist-axle-reception channel and includes a hoist base plate supported by the horizontal support plate. Game, such as a deer, can be supported by the hoist assembly and rotated around the support bracket assembly on the hoist axle and the hoist base plate. In accordance with one embodiment of the invention, the support bracket assembly includes mounting plates for mounting on the rear of the vehicle. In accordance with another embodiment of the invention, the support bracket assembly is mounted on a side of the vehicle. In this case, the support bracket assembly includes a horizontal support plate, and a horizontally oriented bracket-to-vehicle connector is connected to the horizontal support plate. A complimentary horizontally oriented vehicle-to-bracket connector is located on the vehicle for connection with the bracket-to-vehicle connector. The horizontal support plate includes a foot-reception area for receiving a foot of a driver of the vehicle. A hoist locking arm assembly is connected to the vehicle and is used to lock the hoist assembly when not in use.

19 Claims, 6 Drawing Sheets

10
11
2
21
4
25
37
27
43
19
18
22
14
12
2
32
36
34
30

39
3
3
25
21
10
27
37
43
19
22
46
14
32
20
16
34

VEHICLE-MOUNTED HOIST APPARATUS

CROSS-REFERENCE TO RELATED APPLICATION

This application claims priority based upon my prior copending Provisional application Ser. No. 60/079,065, filed Mar. 23, 1998.

BACKGROUND OF THE INVENTION

1. Field of the Invention

The present invention relates generally to hoist assemblies and, more particularly, to hoist assemblies mounted on motor vehicles.

2. Description of the Prior Art

The combination of a hoist assembly and a motor vehicle is well known. More specifically, for hunters, it is very useful for a hoist assembly to be provided on a motor vehicle so that game can be carried, suspended, and dressed while out in the field. In this respect, throughout the years, a number of innovations have been developed relating to hoist assemblies mounted on motor vehicles, and the following U.S. Pat. Nos. are representative of some of those innovations: 4,338,703, 4,806,063, 5,562,534, and 5,662,451. More specifically, U.S. Pat. No. 4,338,703 discloses a hoist assembly for game animals that is supported in a slot typically provided in a side wall of a bed of a pickup truck. However, a popular type of motor vehicle is an all terrain vehicle (ATV), and it would be desirable if a hoist assembly were provided that is adapted to be used on an ATV.

U.S. Pat. No. 4,806,063 discloses a portable wild game hoist that is supported by a bumper of a motor vehicle. However, some motor vehicles do not have bumpers, and in this respect, it would be desirable if a hoist assembly were provided that is adapted to be used on a motor vehicle without being supported by a bumper.

U.S. Pat. No. 5,419,672 discloses a hoist assembly that is supported by the tailgate of a pickup truck. Some motor vehicles do not have tailgates, and, in this respect, it would be desirable if a hoist assembly were provided for a motor vehicle that does not include a tailgate.

U.S. Pat. No. 5,662,451 discloses a game hoist that is supported by an ATV. It is noted, however, that the hoist assembly has a square lower portion that fits into a square vertical shaft reception portion. As a result, the hoist assembly cannot be rotated around the vertical shaft reception portion. For greater versatility, it would be desirable if a hoist assembly for a motor vehicle were provided that can be readily rotated in a vertical shaft reception portion.

As a matter of interest, U.S. Pat. No. 5,562,534 discloses a hoist assembly that is attached to a tree for skinning game out in the field.

Still other features would be desirable in a vehicle-mounted hoist apparatus. For example, hoists that are mounted on motor vehicles discussed above are mounted either on the front or the back of the motor vehicle. If access to either the front or the back of a motor vehicle is limited, it may be desirable, however, if a hoist were mounted on a side portion of a motor vehicle.

When a hoist assembly is mounted on a motor vehicle, and the hoist assembly is not in use, the hoist assembly may rattle and move during operation of the motor vehicle. In this respect, it would be desirable if means were provided for locking the hoist assembly in a secured status on the motor vehicle when the hoist assembly is not being used.

Thus, while the foregoing body of prior art indicates it to be well known to use vehicle-mounted hoists, the prior art described above does not teach or suggest a vehicle-mounted hoist apparatus which has the following combination of desirable features: (1) is adapted to be used on an ATV; (2) is not supported by a bumper on the vehicle; (3) is useful on a motor vehicle that does not have a tailgate; (4) can be readily rotated in a vertical shaft reception portion; (5) is mounted on a side portion of a motor vehicle; and (6) has means for locking the hoist assembly in a secured status on the motor vehicle when the hoist assembly is not being used. The foregoing desired characteristics are provided by the unique vehicle-mounted hoist apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a hoist apparatus which includes a support bracket assembly for mounting on the vehicle. The support bracket assembly includes a horizontal support plate and a hoist-axle-reception channel depending downward from the horizontal support plate. A hoist assembly is provided and is supported by the support bracket assembly. The hoist assembly includes a hoist axle received in the hoist-axle-reception channel and includes a hoist base plate supported by the horizontal support plate. The support bracket assembly can be attached to an all terrain vehicle (ATV), and game, such as a deer, can be supported by the hoist assembly and rotated around the support bracket assembly on the hoist axle and the hoist base plate.

In accordance with one embodiment of the invention, the support bracket assembly includes mounting plates for mounting on the vehicle. Support struts are connected to the mounting plates, and stabilizer struts are mounted on one of the support struts for stabilizing the hoist-axle-reception channel and the horizontal support plate. The hoist-axle-reception channel is supported by one of the support struts.

The hoist assembly includes a hoist post which projects upward from the hoist base plate. A hoist boom assembly is supported by the hoist post and projects transversely from the hoist post. A reel assembly is supported by the hoist post. The reel assembly can be in the form of a well know winch assembly. A flexible hoist line is reeled onto the reel assembly, extends along the hoist boom assembly, and extends downward from the hoist boom assembly. The hoist line is in the form of a strap. The hoist boom assembly has a top boom portion which protects the hoist line from rain and snow.

The reel assembly includes a reel handle and a ratcheting lock assembly for locking the reel assembly in a desired position. A hoist hook is suspended from a free end of the hoist line. A hook-retention eye is attached to the hoist post for retaining the hoist hook when the hoist hook is not in use. The hoist boom assembly includes a boom pulley located at a distal end of the hoist boom assembly.

The mounting plates include a top mounting plate and a bottom mounting plate. The support struts include a first support strut connected between the top mounting plate and the bottom mounting plate. A second support strut is connected to the top mounting plate and projects horizontally from the top mounting plate. A third support strut is connected between the bottom mounting plate and a distal end of the second support strut. The first support strut, the second support strut, and the third support strut form a triangular support structure.

The stabilizer struts include a first stabilizer strut connected between a proximal portion of the second support strut and a proximal portion of the horizontal support plate. A second stabilizer strut is connected between a distal portion of the second support strut and a distal portion of the horizontal support plate. Rotation prevention means are provided for preventing rotation between the hoist assembly and the support bracket assembly.

The rotation prevention means include support-plate bolt reception channels located in the horizontal support plate, base-plate bolt reception channels located in the hoist base plate, and lock bolts received in the support-plate bolt reception channels and the base-plate bolt reception channels when the support-plate bolt reception channels and the base-plate bolt reception channels are placed in registration.

In accordance with another embodiment of the invention, the support bracket assembly includes a horizontal support plate, and a horizontally oriented bracket-to-vehicle connector is connected to the horizontal support plate. A complimentary horizontally oriented vehicle-to-bracket connector is located on the vehicle for connection with the bracket-to-vehicle connector. The horizontal support plate includes a foot-reception area for receiving a foot of a driver of the vehicle. The hoist-axle-reception channel is in a form of a hoist-axle-reception tube supported by the horizontal support plate. The hoist-axle-reception tube is oriented at an orientation angle with respect to the horizontal support plate. The orientation angle is approximately forty-five degrees. A tube reinforcement member is connected between the hoist-axle-reception tube and the horizontal support plate.

A hoist locking arm assembly is connected to the vehicle and includes an arm pivot assembly connected to the vehicle. A lock arm is connected to the arm pivot assembly. A hoist-reception member is connected to the lock arm. The hoist-reception member is U-shaped. The lock arm includes a hook eye. An arm clamp attached to the vehicle for retaining the lock arm when in a downward, non-use orientation.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved vehicle-mounted hoist apparatus which has all of the advantages of the prior art and none of the disadvantages.

It is another object of the present invention to provide a new and improved vehicle-mounted hoist apparatus which may be easily and efficiently manufactured and marketed.

It is a further object of the present invention to provide a new and improved vehicle-mounted hoist apparatus which is of durable and reliable construction.

An even further object of the present invention is to provide a new and improved vehicle-mounted hoist apparatus which is susceptible of a low cost of manufacture with regard to both materials and labor, and which accordingly is then susceptible of low prices of sale to the consuming public, thereby making such vehicle-mounted hoist apparatus available to the buying public.

Still yet a further object of the present invention is to provide a new and improved vehicle-mounted hoist apparatus which is adapted to be used on an ATV.

Still another object of the present invention is to provide a new and improved vehicle-mounted hoist apparatus that is not supported by a bumper on the vehicle.

Yet another object of the present invention is to provide a new and improved vehicle-mounted hoist apparatus which is useful on a motor vehicle that does not have a tailgate.

Even another object of the present invention is to provide a new and improved vehicle-mounted hoist apparatus that can be readily rotated in a vertical shaft reception portion.

Still a further object of the present invention is to provide a new and improved vehicle-mounted hoist apparatus which is mounted on a side portion of a motor vehicle.

Yet another object of the present invention is to provide a new and improved vehicle-mounted hoist apparatus that has means for locking the hoist assembly in a secured status on the motor vehicle when the hoist assembly is not being used.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof Such description makes reference to the annexed drawing wherein.

DESCRIPTION OF THE PREFERRED EMBODIMENT

Figure 1:
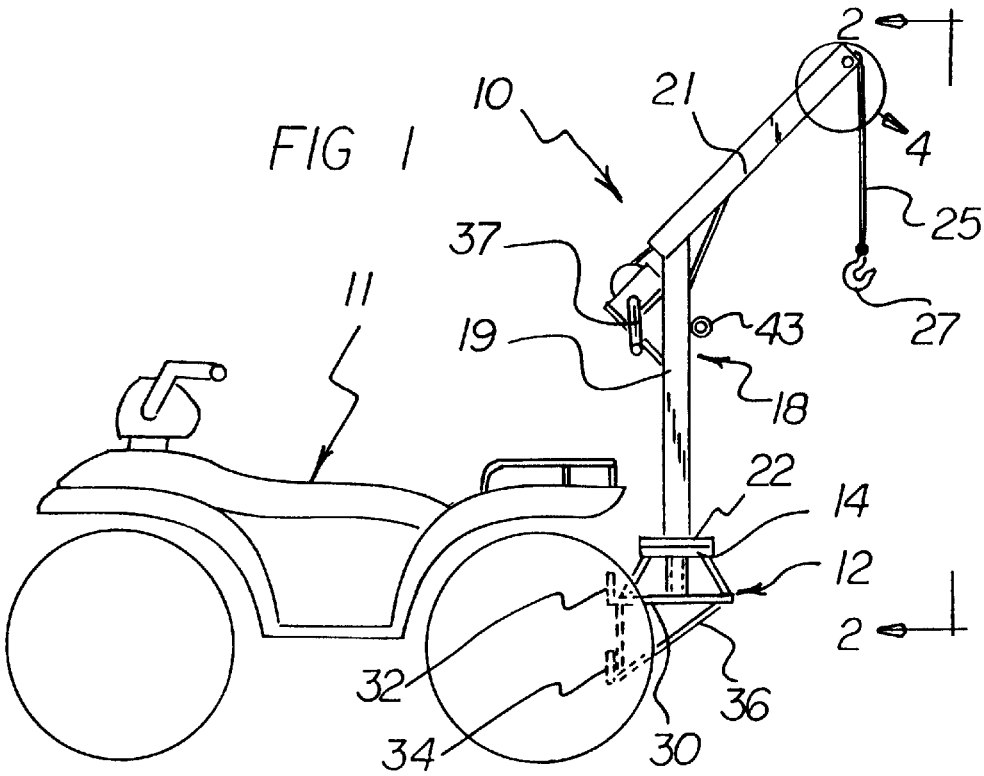
FIG. 1 is a side view showing a first embodiment of the vehicle-mounted hoist apparatus of the invention mounted at the rear of an all terrain vehicle (ATV).
Figure 2:
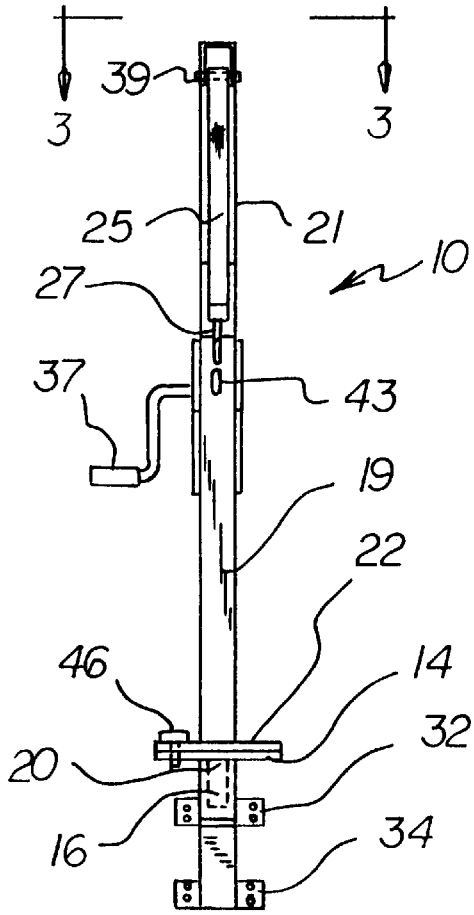
FIG. 2 is an enlarged front view of the embodiment of the vehicle-mounted hoist apparatus shown in FIG. 1 taken along line 2—2 of FIG. 1.
Figure 3:
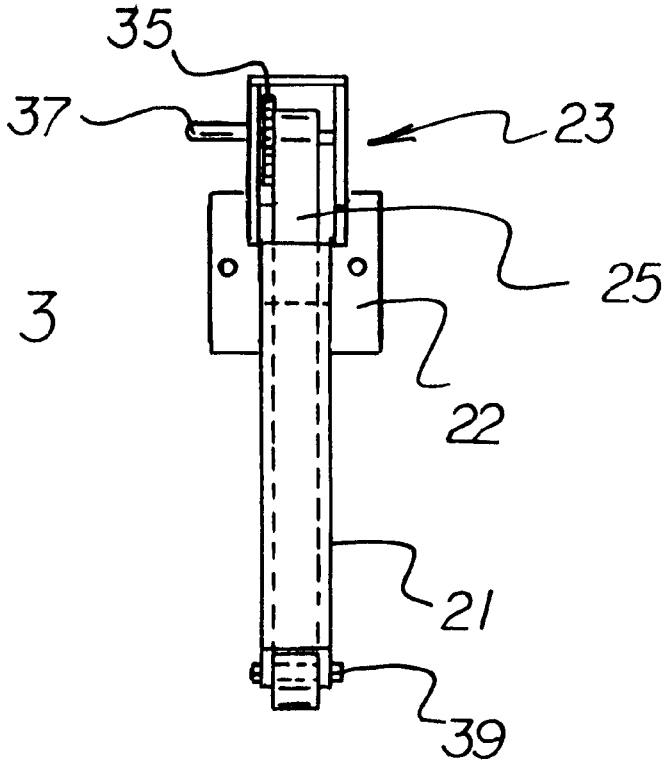
FIG. 3 is a top view of the embodiment of the vehicle-mounted hoist apparatus of FIG. 2 taken along line 3—3 thereof.
Figure 4:
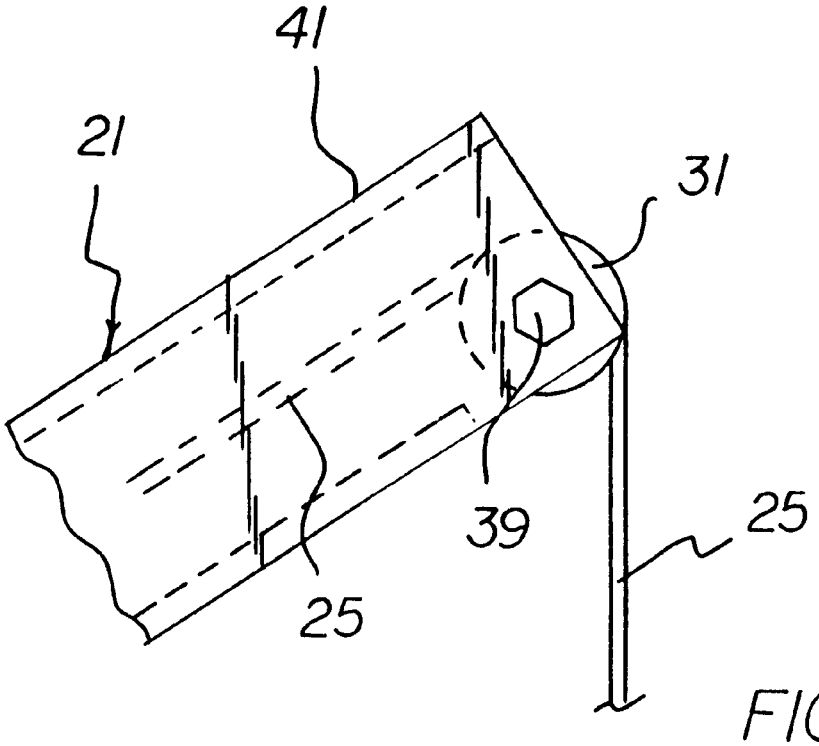
FIG. 4 is an enlarged side view of the portion of the embodiment of the invention shown in FIG. 1 taken in the circled region 4 thereof.
Figure 5:
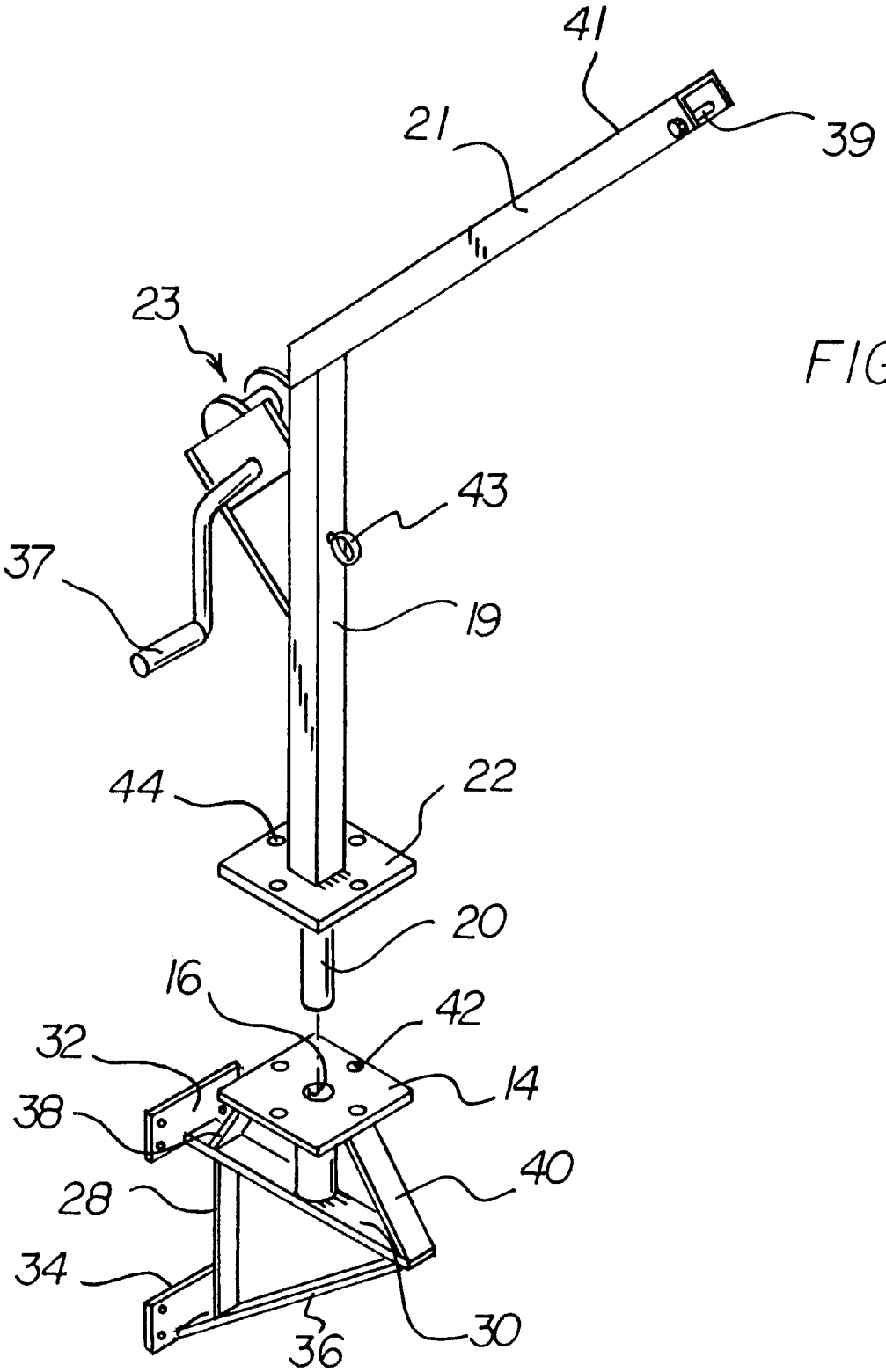
FIG. 5 is a partially exploded perspective view of the embodiment of the invention shown in FIG. 1 removed from the all terrain vehicle (ATV).

With reference to the drawings, a new and improved vehicle-mounted hoist apparatus embodying the principles and concepts of the present invention will be described.

Turning to FIGS. 1–5, there is shown a first embodiment of the vehicle-mounted hoist apparatus of the invention generally designated by reference numeral 10. The vehicle-mounted hoist apparatus 10 includes a support bracket assembly 12 for mounting on the vehicle 11. The support bracket assembly 12 includes a horizontal support plate 14 and a hoist-axle-reception channel 16 depending downward from the horizontal support plate 14. A hoist assembly 18 is provided and is supported by the support bracket assembly 12. The hoist assembly includes a hoist axle 20 received in the hoist-axle-reception channel 16 and includes a hoist base plate 22 supported by the horizontal support plate 14. The support bracket assembly 12 can be attached to an all terrain vehicle (ATV), and game, such as a deer, can be supported by the hoist assembly 18 and rotated around the support bracket assembly 12 on the hoist axle 20 and the hoist base plate 22.

The support bracket assembly 12 includes mounting plates for mounting on the vehicle 11. Support struts are connected to the mounting plates, and stabilizer struts are mounted on one of the support struts for stabilizing the hoist-axle-reception channel 16 and the horizontal support plate 14. The hoist-axle-reception channel 16 is supported by one of the support struts.

The hoist assembly 18 includes a hoist post 19 which projects upward from the hoist base plate 22. A hoist boom assembly 21 is supported by the hoist post 19 and projects transversely from the hoist post 19. A reel assembly 23 is supported by the hoist post 19. The reel assembly 23 can be in the form of a well know winch assembly. A flexible hoist line 25 is reeled onto the reel assembly 23, extends along the hoist boom assembly 21, and extends downward from the hoist boom assembly 21. The hoist line 25 is in the form of a strap 25. The hoist boom assembly 21 has a top boom portion 41 which protects the hoist line 25 from rain and snow.

The reel assembly 23 includes a reel handle 37 and a ratcheting lock assembly 35 for locking the reel assembly 23 in a desired position. A hoist hook 27 is suspended from a free end of the hoist line 25. A hook-retention eye 43 is attached to the hoist post 19 for retaining the hoist hook 27 when the hoist hook 27 is not in use.

The hoist boom assembly 21 includes a boom pulley 31 located at a distal end of the hoist boom assembly 21. The boom pulley 31 includes a boom axle 39.

The mounting plates include a top mounting plate 32 and a bottom mounting plate 34. The support struts include a first support strut 28 connected between the top mounting plate 32 and the bottom mounting plate 34. A second support strut 30 is connected to the top mounting plate 32 and projects horizontally from the top mounting plate 32. A third support strut 36 is connected between the bottom mounting plate 34 and a distal end of the second support strut 30. The first support strut 28, the second support strut 30, and the third support strut 36 form a triangular support structure.

The stabilizer struts include a first stabilizer strut 38 connected between a proximal portion of the second support strut 30 and a proximal portion of the horizontal support plate 14. A second stabilizer strut 40 is connected between a distal portion of the second support strut 30 and a distal portion of the horizontal support plate 14. Rotation prevention means are provided for preventing rotation between the hoist assembly 18 and the support bracket assembly 12.

The rotation prevention means include support-plate bolt reception channels 42 located in the horizontal support plate 14, base-plate bolt reception channels 44 located in the hoist base plate 22, and lock bolts 46 received in the support-plate bolt reception channels 42 and the base-plate bolt reception channels 44 when the support-plate bolt reception channels 42 and the base-plate bolt reception channels 44 are placed in registration.

To use the hoist apparatus 10 of the invention, the top mounting plate 32 and the bottom mounting plate 34 are bolted onto a rear a portion of a vehicle 11, such as the all terrain vehicle (ATV) shown in FIG. 1. Then, the hoist axle 20 is inserted into the hoist-axle-reception channel 16. When this is done, the hoist base plate 22 rests on the horizontal support plate 14, and the hoist assembly 18 can be rotated on the hoist axle 20 around the horizontal support plate 14. The reel handle 37 is operated to pay out some of the hoist line 25 so that the hoist hook 27 is lowered. An item, such as game, e.g. a deer, is hung from the hoist hook 27. Then, the reel handle 37 is turned in the opposite direction to elevate the game on the hoist hook 27. In the elevated position, the game can be dressed.

If it is desired to rotate the game around the hoist axle 20, then the hoist boom assembly 21 is moved so that the hoist post 19 rotates around hoist-axle-reception channel 16 in the support bracket assembly 12. This technique is especially useful to swing hanging game onto a back carrying area of the all terrain vehicle (ATV). Once the hanging game is positioned over the carrying area, the game is lowered with by turning the reel handle 37.

On the other hand, if it desired to fix the position of the hoist assembly 18 with respect to the support bracket assembly 12, then the support-plate bolt reception channels 42 and the base-plate bolt reception channels 44 are placed in registration, and one or more lock bolts 46 is inserted through the registered support-plate bolt reception channels 42 and the base-plate bolt reception channels 44. Once this is done, rotation of the hoist assembly 18 with respect to the support bracket assembly 12 is prevented.

When the hoist apparatus 10 is no longer to be used for a period of time, the lock bolts 46 can be removed, and the hoist axle 20 is lifted out from the hoist-axle-reception channel 16. To prevent the hoist hook 27 from swinging freely, the hoist hook 27 is hooked onto the hook-retention eye 43 on the hoist post 19. Then, the hoist assembly 18 can be placed in storage or in the vehicle 11 for transportation to another site. When the hoist apparatus 10 is to be used again, the hoist axle 20 is inserted into the hoist-axle-reception channel 16, the hoist base plate 22 rests on the horizontal support plate 14, the hoist hook 27 is unhooked from the hook-retention eye 43, and the apparatus is once again ready for use.

Now turning to the second embodiment of the invention, shown in FIGS. 6–11, the support bracket assembly 12 includes a horizontal support plate 14, and a horizontally oriented bracket-to-vehicle connector 50 is connected to the horizontal support plate 14. A complimentary horizontally oriented vehicle-to-bracket connector 52 is located on the vehicle 11 for connection with the bracket-to-vehicle connector 50. The horizontal support plate 14 includes a foot-reception area 15 for receiving a foot of a driver of the vehicle 11.

The hoist-axle-reception channel is in a form of a hoist-axle-reception tube 56 supported by the horizontal support plate 14. The hoist-axle-reception tube 56 is oriented at an orientation angle 58 with respect to the horizontal support plate 14. The orientation angle 58 is approximately forty-five degrees. A tube reinforcement member 61 is connected between the hoist-axle-reception tube 56 and the horizontal support plate 14.

A hoist locking arm assembly 60 is connected to the vehicle 11 and includes an arm pivot assembly 62 connected to the vehicle 11. A lock arm 64 is connected to the arm pivot assembly 62. A hoist-reception member 66 is connected to the lock arm 64. The hoist-reception member 66 is U-shaped. The lock arm 64 includes a hook eye 63. An arm clamp 68 attached to the vehicle 11 for retaining the lock arm 64 when in a downward, non-use orientation.

To use the second embodiment of the hoist apparatus 10 of the invention, the bracket-to-vehicle connector 50, which is in a form of a solid rectangular member, is inserted into the complimentary vehicle-to-bracket connector 52 on the vehicle 11. Then, the hoist axle 20 of the hoist assembly 18 is inserted into the hoist-axle-reception tube 56. It is noted, also, that the bracket-to-vehicle connector 50 is easily removable from the vehicle-to-bracket connector 52. Therefore, the second embodiment of the invention can easily be added to or removed from the vehicle 11.

Figure 6:
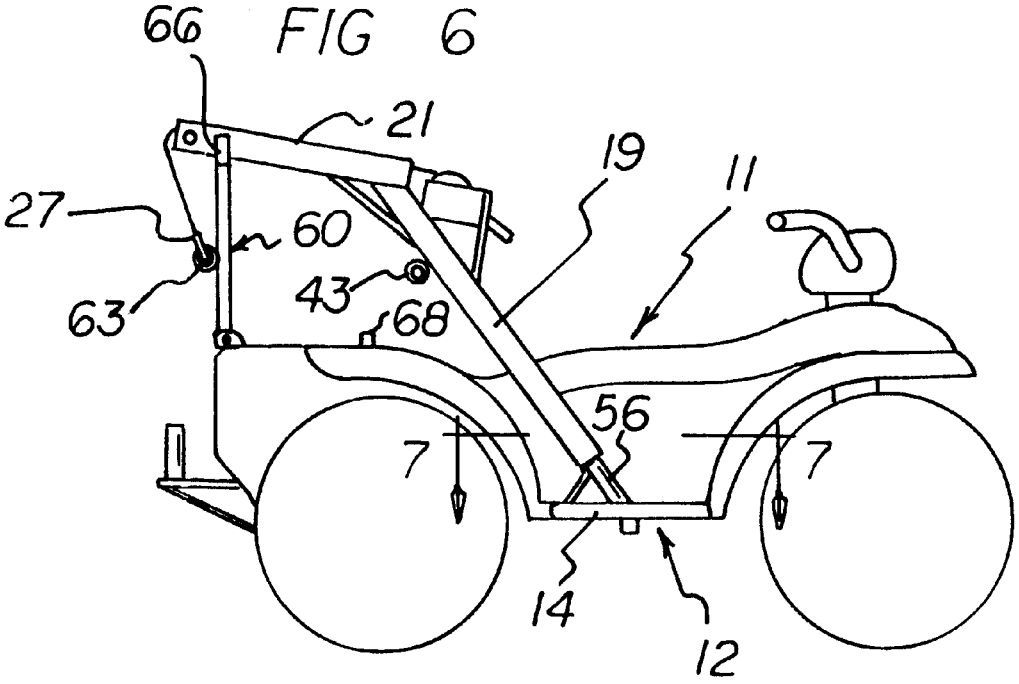
FIG. 6 is a side view showing a second embodiment of the vehicle-mounted hoist apparatus of the invention mounted at the side of an all terrain vehicle (ATV).
Figure 7:
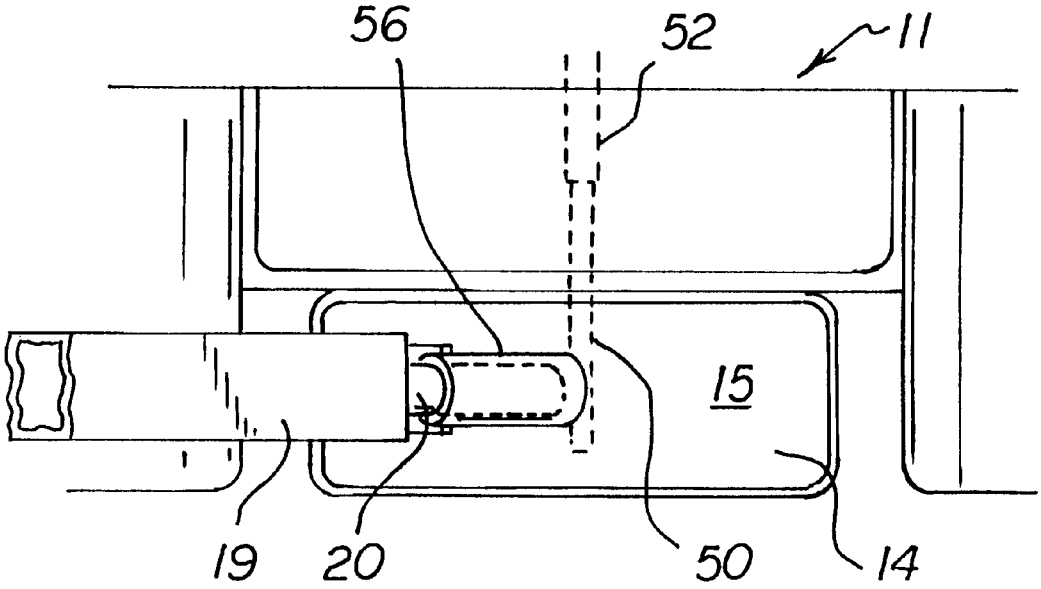
FIG. 7 an enlarged partial top view of the embodiment of the invention shown in FIG. 6 taken along line 7—7 thereof.
Figure 8:
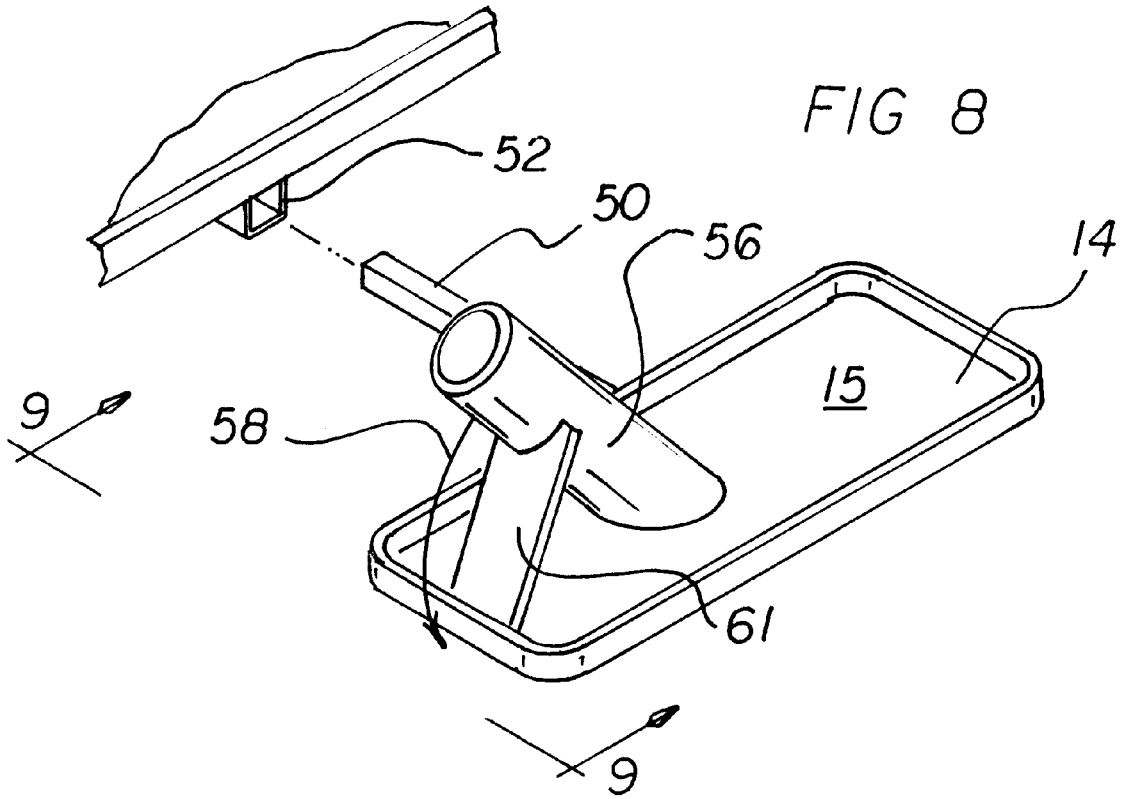
FIG. 8 is a perspective view of the embodiment of the invention shown in FIG. 7 with the hoist assembly removed from the support bracket assembly.
Figure 9:
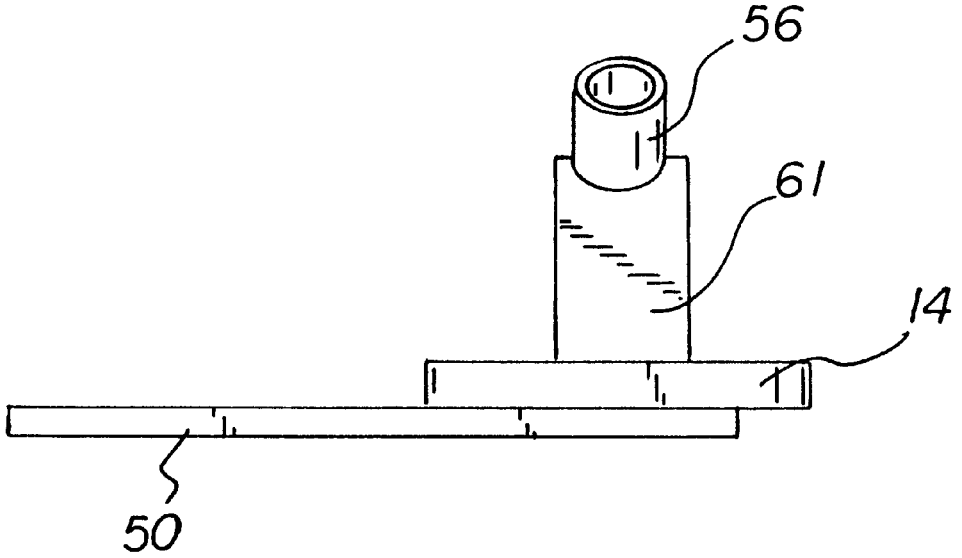
FIG. 9 is a front view of the embodiment of the invention shown in FIG. 8 taken along line 9—9 thereof.
Figure 10:
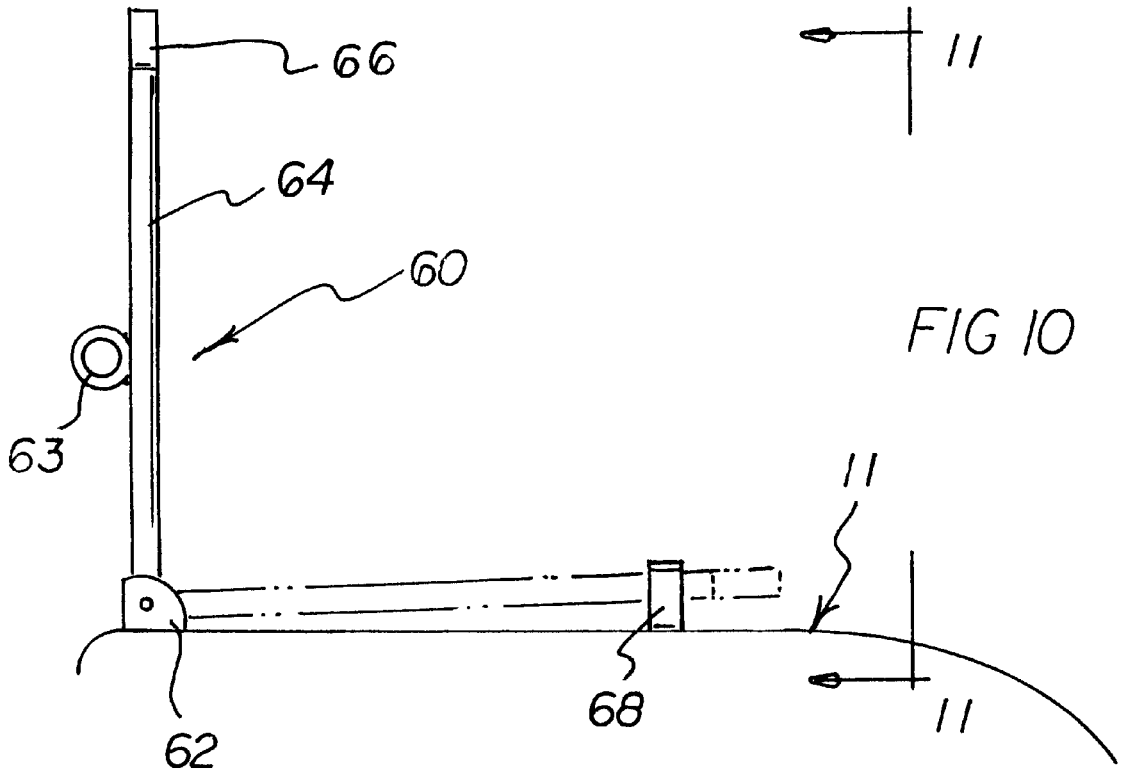
FIG. 10 is a side view of hoist locking arm in an upright, shown in solid lines, and in a down, storage position, shown in broken lines.
Figure 11:
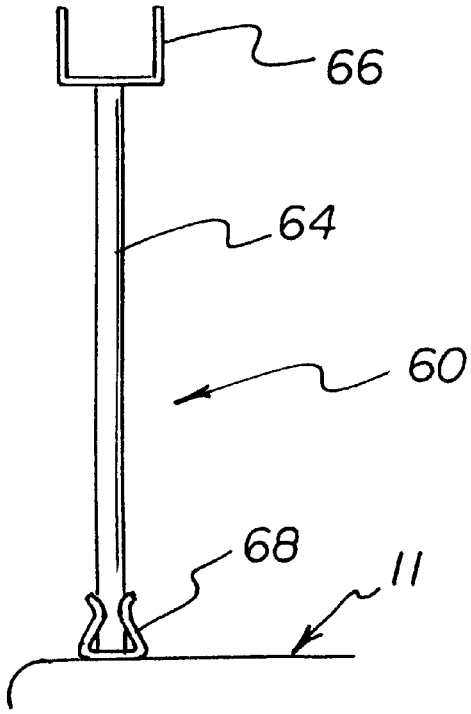
FIG. 11 is a front view of the hoist locking arm shown in FIG. 10 taken along line 11—11 thereof.

As shown in FIG. 6, when the hoist assembly 18 is not used for holding an object such as a deer carcass, the hoist-reception member 66 is engaged with the hoist boom assembly 21, the hoist hook 27 is connected to the hook eye 63 on the hoist locking arm assembly 60, and the flexible hoist line 25 is tightened on the reel assembly 23. As a result, the position of the hoist assembly 18 is stabilized and prevent from rotation around the hoist axle 20. With respect to the hoist locking arm assembly 60, this orientation of the hoist locking arm assembly 60 is shown in FIG. 10 in the solid-line drawing.

On the other hand, when the hoist assembly 18 is in use, the hoist hook 27 is disconnected from the hook eye 63, and the lock arm 64 is moved around the arm pivot assembly 62 to engage the arm clamp 68. Then, the hoist assembly 18, with its hoist axle 20 in the hoist-axle-reception tube 56, is free to rotate around the hoist-axle-reception tube 56. With respect to the hoist locking arm assembly 60, this orientation of the hoist locking arm assembly 60 is shown in the broken-line drawing in FIG. 10. The foot-reception area 15 of the horizontal support plate 14 can be used for receiving a driver's foot when the vehicle 11 is driven. In accordance with another aspect of the invention, instead of installing a hoist assembly 18 on the vehicle 11, a tree stand can be installed on the vehicle 11.

The components of the vehicle-mounted hoist apparatus of the invention can be made from inexpensive and durable metal, e.g. steel or aluminum, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved vehicle-mounted hoist apparatus that is low in cost, relatively simple in design and operation, and which may advantageously be used on an ATV. With the invention, a vehicle-mounted hoist apparatus is provided which is not supported by a bumper on the vehicle. With the invention, a vehicle-mounted hoist apparatus is provided which is useful on a motor vehicle that does not have a tailgate. With the invention, a vehicle-mounted hoist apparatus is provided which can be readily rotated in a vertical shaft reception portion. With the invention, a vehicle-mounted hoist apparatus is provided which is mounted on a side portion of a motor vehicle. With the invention, a vehicle-mounted hoist apparatus is provided which has means for locking the hoist assembly in a secured status on the motor vehicle when the hoist assembly is not being used.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A hoist apparatus for mounting on a vehicle, comprising:

a support bracket assembly for mounting on the vehicle, wherein said support bracket assembly includes a horizontal support plate and a hoist-axle-reception channel attached to said horizontal support plate, and a hoist assembly which includes a hoist axle received in said hoist-axle-reception channel and includes a hoist base plate supported by said horizontal support plate, wherein said hoist-axle-reception channel depends downwardly from said horizontal support plate, wherein said hoist axle is rotatable in said hoist-axle-reception channel, wherein said support bracket assembly includes:

mounting plates for mounting on the vehicle, support struts connected to said mounting plates, stabilizer struts mounted on one of said support struts for stabilizing said hoist-axle-reception channel and said horizontal support plate, wherein said hoist-axle-reception channel is supported by one of said support struts.

2. The apparatus of claim 1 wherein said hoist assembly includes:

a hoist post projecting upward from said hoist base plate, a hoist boom assembly supported by said hoist post and projecting transversely from said hoist post, a reel assembly supported by said hoist post, and a flexible hoist line reeled onto said reel assembly, extending along said hoist boom assembly, and extending downward from said hoist boom assembly.

3. The apparatus of claim 2 wherein said reel assembly is in the form of a winch assembly.

4. The apparatus of claim 2 wherein said hoist line is in the form of a strap.

5. The apparatus of claim 2 wherein said hoist boom assembly has a top boom portion which protects said hoist line from rain and snow.

6. The apparatus of claim 2 wherein said reel assembly includes a reel handle and a ratcheting lock assembly for locking said reel assembly in a desired position.

7. The apparatus of claim 2, further including:

a hoist hook suspended from a free end of said hoist line.

8. The apparatus of claim 2, further including:

a hook-retention eye attached to said hoist post for retaining said hoist hook when said hoist hook is not in use.

9. The apparatus of claim 2 wherein said hoist boom assembly includes a boom pulley located at a distal end of said hoist boom assembly.

10. The apparatus of claim 1 wherein said mounting plates include:

a top mounting plate, and a bottom mounting plate.

11. The apparatus of claim 10 wherein said support struts include:

a first support strut connected between said top mounting plate and said bottom mounting plate, a second support strut connected to said top mounting plate and projecting horizontally from said top mounting plate, a third support strut connected between said bottom mounting plate and a distal end of said second support strut, wherein said first support strut, said second support strut, and said third support strut form a triangular support structure.

12. The apparatus of claim 1 wherein said stabilizer struts include:

a first stabilizer strut connected between a proximal portion of said second support strut and a proximal portion of said horizontal support plate, and a second stabilizer strut connected between a distal portion of said second support strut and a distal portion of said horizontal support plate.

13. The apparatus of claim 1, further including:

rotation prevention means for preventing rotation between said support bracket assembly and said hoist assembly.

14. The apparatus of claim 13 wherein said rotation prevention means include:

support-plate bolt reception channels located in said horizontal support plate, base-plate bolt reception channels located in said hoist base plate, and lock bolts received in said support-plate bolt reception channels and said base-plate bolt reception channels when said support-plate bolt reception channels and said base-plate bolt reception channels are placed in registration.

15. A hoist apparatus for mounting on a vehicle, comprising:

a support bracket assembly adapted for mounting on said vehicle, wherein said support bracket assembly includes a horizontal support plate, a hoist-axle-reception channel attached to said horizontal support plate, a horizontally oriented bracket-to-vehicle connector connected to said horizontal support plate, and a complimentary horizontally oriented vehicle-to-bracket connector adapted to be located on said vehicle, for connection with said bracket-to-vehicle connector, and a hoist assembly which includes a hoist axle received in said hoist-axle-reception channel and includes a hoist base plate supported by said horizontal support plate, wherein said hoist axle is rotatable in said a hoist-axle-reception channel, and wherein said a hoist-axle-reception channel is in a form of a hoist-axle-reception tube supported by said horizontal support plate, wherein said hoist-axle-reception tube is oriented at an orientation angle with respect to said horizontal support plate, and wherein said orientation angle is approximately forty-five degrees.

16. The apparatus of claim 15 wherein said horizontal support plate includes a foot-reception area for receiving a foot of a driver of the vehicle.

17. A hoist apparatus for mounting on a vehicle, comprising:

a support bracket assembly adapted for mounting on said vehicle, wherein said support bracket assembly includes a horizontal support plate, a hoist-axle-reception channel attached to said horizontal support plate, a horizontally oriented bracket-to-vehicle connector connected to said horizontal support plate, and a complimentary horizontally oriented vehicle-to-bracket connector adapted to be located on said vehicle, for connection with said bracket-to-vehicle connector, and a hoist assembly which includes a hoist axle received in said hoist-axle-reception channel and wherein said hoist axle is rotatable in said a hoist-axle-reception channel, and further including:

a hoist locking arm assembly adapted to be connected to said vehicle, wherein said hoist locking arm assembly includes:

an arm pivot assembly connected to the vehicle, a lock arm connected to said arm pivot assembly, a hoist-reception member connected to said lock arm.

18. The apparatus of claim 17 wherein said lock arm includes a hook eye.

19. The apparatus of claim 17, further including:

an arm clamp adapted to be attached to said vehicle for retaining said lock arm when in a downward, non-use orientation.

* * * * *